United States Patent [19]

Aylott

[11] 4,106,614

[45] Aug. 15, 1978

[54] ARTIFICIAL FINGERNAIL DISPLAY PACKAGE

[76] Inventor: Eric Victor Aylott, Llanfrechfa Way,, Cwmbran, Gwent NP4 2XR, Wales

[21] Appl. No.: 805,218

[22] Filed: Jun. 9, 1977

Related U.S. Application Data

[63] Continuation-in-part of Ser. No. 766,829, Feb. 8, 1977.

[30] Foreign Application Priority Data

Oct. 27, 1976 [GB] United Kingdom ..... 44641/76

[51] Int. Cl.[2] ..... B65D 5/50

[52] U.S. Cl. ..... 206/45.14; 132/73; 206/45.34; 206/332; 206/458; 206/471; 206/581; 206/823

[58] Field of Search ..... 132/73, 73.5, 88.7; 206/223, 823, 581, 458, 457, 495, 471, 332, 38, 235, 45.14, 45.34, 45.33

[56] References Cited

U.S. PATENT DOCUMENTS

| | | | |
|---|---|---|---|
| 3,190,435 | 6/1965 | Schlanger | 206/458 |
| 3,485,344 | 12/1969 | Aylott | 206/45.14 |
| 3,650,430 | 3/1972 | Siegmar et al. | 206/332 |
| 3,661,253 | 5/1972 | Cronkhite | 206/332 |
| 3,774,993 | 11/1973 | Senee | 132/73.5 |
| 3,982,551 | 9/1976 | Bartolucci | 132/73 |

FOREIGN PATENT DOCUMENTS

| | | | |
|---|---|---|---|
| 2,308,501 | 8/1974 | Fed. Rep. of Germany | 132/73 |
| 933,981 | 8/1963 | United Kingdom | 132/73 |

*Primary Examiner*—William Price
*Assistant Examiner*—Bruce H. Bernstein
*Attorney, Agent, or Firm*—Blum, Moscovitz, Friedman & Kaplan

[57] ABSTRACT

An artificial fingernail package has a transparent portion through which one or more artificial fingernails are visible enabling a possible purchaser to select fingernails by placing her finger beneath the transparent portion and looking through the transparent portion. The artificial fingernails may be loose or secured to a retaining frame.

7 Claims, 6 Drawing Figures

ARTIFICIAL FINGERNAIL DISPLAY PACKAGE

CROSS-REFERENCE TO RELATED APPLICATION

This application is a continuation-in-part application of my co-pending application Ser. No. 766,829 filed Feb. 8, 1977, in which I disclosed an artificial fingernail mounting comprising a frame to which a plurality of artificial fingernails are removably secured by their tips leaving the cuticle ends free to facilitate selection thereof. The preferred construction of pack disclosed in my co-pending application included a transparent portion arranged to enable an interested person to examine and select artificial fingernails by placing a finger beneath an artificial fingernail and looking through the transparent portion.

FIELD OF THE INVENTION

This invention relates to an artificial fingernail display package including one or more artificial fingernails.

Whilst the pack disclosed in our cognate co-pending application is perfectly satisfactory the specification thereof is directed to the important aspect of securing fingernails by the tip. However in some instances it may be more convenient either to have the fingernails loose or for example secured by their cuticle ends. At present an artificial fingernail package has a display of artificial fingernails visible from one side of the package only so that selection cannot be easily made.

SUMMARY OF THE PRESENT INVENTION

According to the present invention therefore I provide an artificial fingernail display package comprising a transparent portion, and an artificial fingernail aligned with the transparent portion of the package so that an interested person may place a finger beneath the artificial fingernail and examine the fingernail with respect to suitability by looking through the transparent portion. Such an arrangement makes the selection of artificial fingernails much easier before purchase.

The package may be completely transparent if desired but preferably only part thereof is transparent the remainder being opaque and carrying instructions for application of the fingernails. In a simplified form the artificial fingernails may be disposed in a package straight from the injection mould still connected together by the sprue formed by the passage of plastics material to the individual moulds.

BRIEF DESCRIPTION OF THE DRAWINGS

The invention will now be described by way of example with reference to the accompanying drawings in which.

DESCRIPTION OF THE PREFERRED EMBODIMENTS

Figure 1:
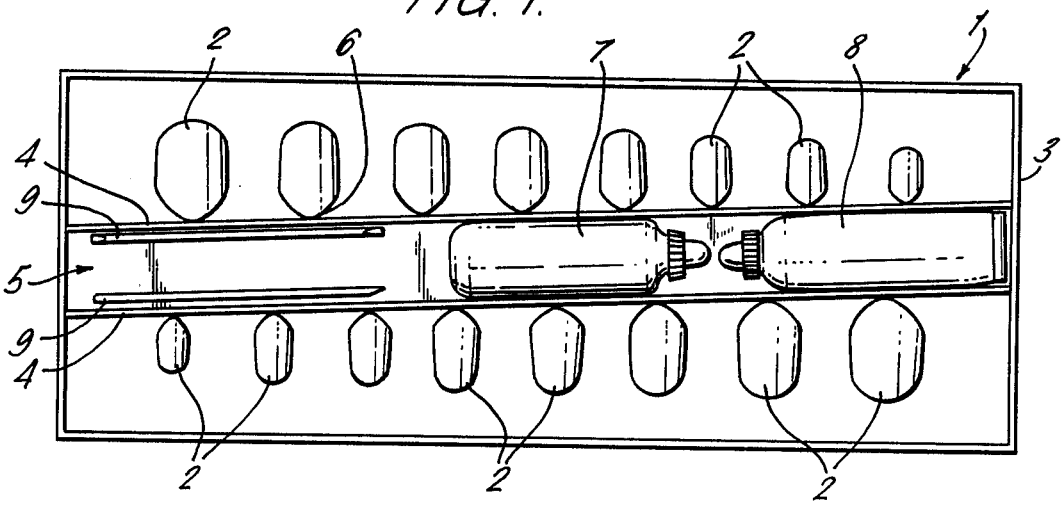
FIG. 1 is a plan view of one form of frame for artificial fingernails.

In the drawings an injection moulded frame 1 of artificial fingernails 2 consists of an outer rectangular surround 3 and a pair of intermediate spaced bars 4 defining a compartment 5. The bars 4 are located at an angle between the shorter sides of the surround 3 to accommodate the various sizes of artificial fingernails 2.

The artificial fingernails 2 are secured to the bars 4 by a weakened portion or nib 6 between the tip of a fingernail and an adjacent bar. Preferably there are eight artificial fingernails provided along each bar 4 to allow for variation in size between users' fingernails. The compartment 5 contains a supply of adhesive 7, a supply of remover 8, an emery board (not shown), instructions (not shown) and one or more cuticle tools 9 for facilitating the location of an artificial fingernail under the cuticle of a user.

Figure 2:
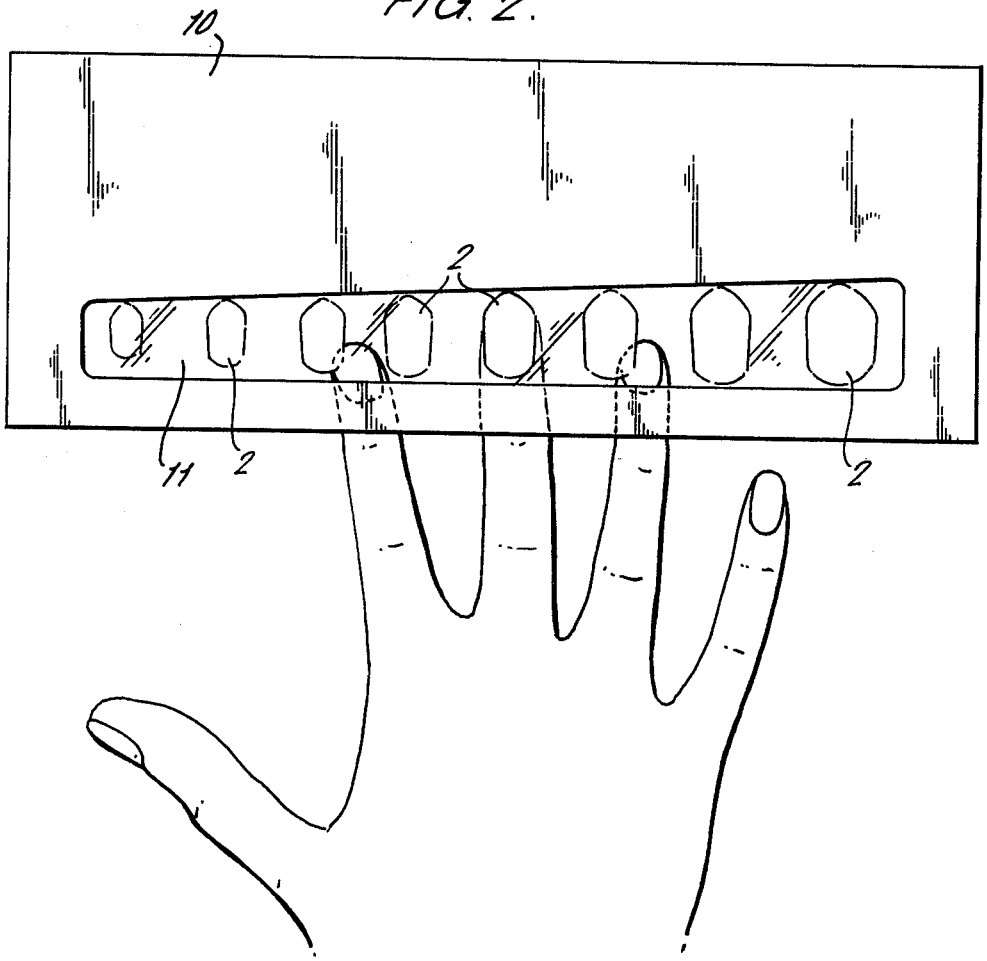
FIG. 2 is a plan view of a package containing the frame.

As shown in FIG. 2 the frame 1 is fitted within a rectangular box 10, which has an aligned transparent portion 11 in the top and bottom of the box, positioned so that one half of the sixteen artificial fingernails 2 are visible on inspection. As shown in FIG. 2, in order to examine the suitability of the fingernails 2, all a potential customer need do is pick up the box and place her finger under the aligned transparent portions 11, and therefore gauge the size suitability.

Figure 3:
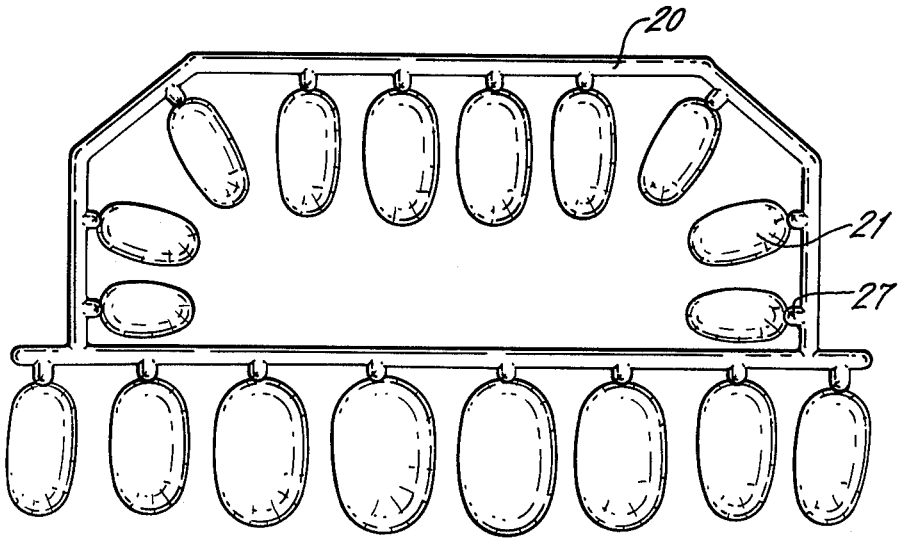
FIG. 3 is a second form of frame for artificial fingernails.
Figure 4:
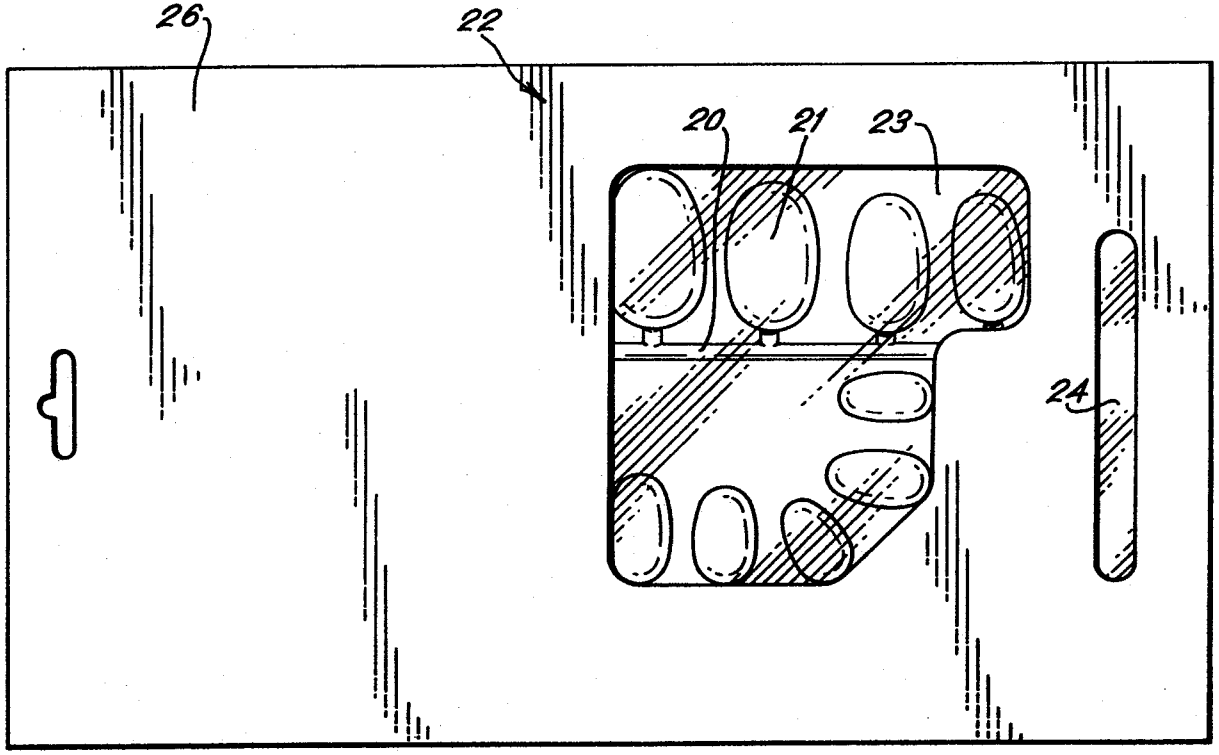
FIG. 4 is a plan view of a package containing the frame of FIG. 3.
Figure 5:
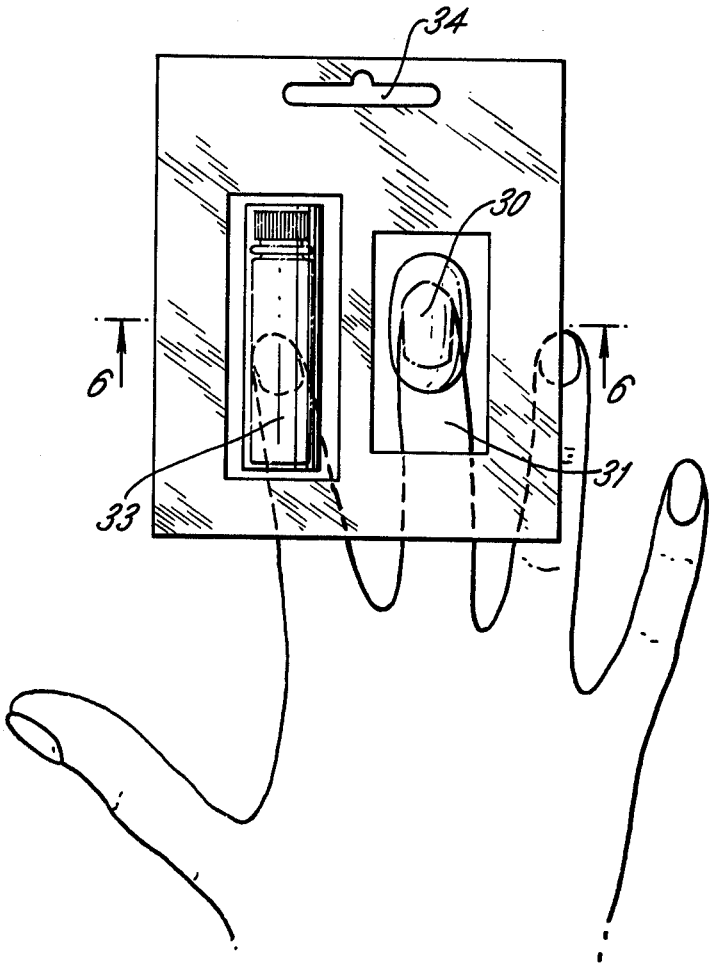
FIG. 5 is a package of a single artificial fingernail.
Figure 6:
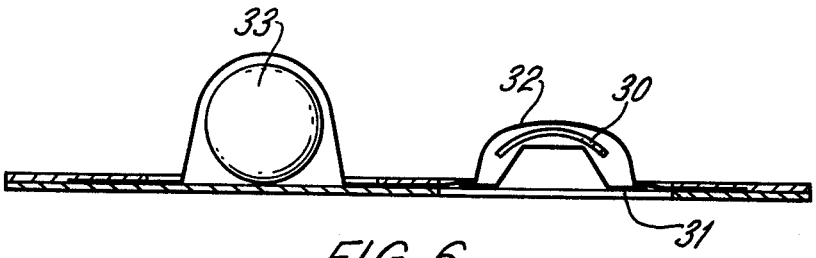
FIG. 6 is a section on 6—6 of FIG. 5.

FIG. 3 illustrates one form of injection moulded fingernail sprue 20 to which artificial fingernails 21 are connected by their cuticle ends 27. In FIG. 4 the sprue 20 and artificial fingernails 21 thereon are disposed within a package 22 having a transparent portion 23 which allows a number of the artificial fingernails 21 to be visible for selection whilst hiding most of the unsightly sprue. The package in FIG. 4 is shown with a compartment for fingernail adhesive 24 and a hole 25 by means of which the package may be suspended on a hook. The portion 26 of the package shown blank normally carries descriptive matter and instructions relating to the artificial fingernails. With this package a person may also select a fingernail by placing her finger beneath the transparent portion 23. The embodiment in FIGS. 5 and 6 is an alternative embodiment where only one artificial fingernail is contained in the package. In FIGS. 5 and 6 the artificial fingernail 30 is not secured to any frame but is retained in position in the transparent portion 31 by a vacuum-formed inset 32 which engages the artificial fingernail 30 as clearly shown in FIG. 6. As with the previous embodiment the package of FIGS. 5 and 6 also includes a compartment for adhesive 33 and a hole 34 for supporting the package during display.

It is understood that although not illustrated the artificial fingernails in the first and second embodiments may be surrounded by individual vacuum-formed insets similar to the inset 32 of the third embodiment. In this way the artificial fingernails will be retained in position even if they happen to break away from the frame to which they are attached. It will also be understood that the shape of frame is unimportant providing the package is designed with a particular frame in mind so that a desired number of artificial fingernails are displayed through the transparent portion.

The package of the present invention is particularly useful in selling artificial nails to girls who may be embarrased by the condition of their own nails, since it allows the girls to test the nails for themselves without the aid of a shop assistant. For example FIGS. 2 and 5 clearly illustrate a girl's hand below the transparent portion allowing selection of the artificial fingernails to be effected without removing the fingernails from the package.

What is claimed is:

1. A package for the storage, handling and display of artificial fingernails comprising at least one artificial fingernail having a rear securing surface and a front surface, support means for fixedly positioning each said fingernail, packaging means for defining an enclosure surrounding each said fingernail, said packaging means including opposed transparent walls respectively disposed above and below the front and rear surfaces of each fingernail, said opposed transparent walls being dimensioned with respect to each said fingernail to permit the entire fingernail to be viewed and further permit a natural fingernail to be placed in substantially flush alignment against the wall below the rear surface of said artificial fingernail so that a size comparison and observance of the attractiveness of the artificial fingernail can be effected without removing the fingernail from said enclosure defined by said packaging means.

2. A package as claimed in claim 1, wherein said packaging means and said support means are both defined as a shaped vacuum-formed inset for retaining and aligning the artificial fingernails with the opposed transparent walls so that the opposed transparent walls surround the artificial fingernail and make same visible therethrough.

3. A package as claimed in claim 1, wherein said support means defines a shaped vacuum-formed transparent inset for permitting said fingernail to be viewed and further permitting a natural fingernail to be placed in substantially flush alignment beneath said artificial fingernail so that a size comparison and observance of the attractiveness of the artificial fingernail can be effected without removing the fingernail from said enclosure defined by said packaging and support means.

4. A package as claimed in claim 1, wherein said support means includes a frame for supporting a plurality of artificial fingernails connected to said frame, so that certain of said artificial fingernails are secured in a position to maintain same visible through said opposed transparent walls.

5. A package as claimed in claim 4, wherein each of said artificial fingernails includes a cuticle end, each said artificial fingernail being secured to said frame by its cuticle end.

6. A package as claimed in claim 1, wherein said packaging means includes a box, said box being formed in the shape of a parallelepiped, said opposed transparent walls being defined by windows formed in opposed planar surfaces, said windows being positioned and arranged proximate to at least one fingernail to permit the entire fingernail to be viewed and further permit a natural fingernail to be placed in substantially flush alignment beneath said artificial fingernail so that a size comparison and observance of the attractiveness of the artificial fingernail can be effected without removing the fingernail from said enclosure defined by said box.

7. A package as claimed in claim 6, wherein said support means includes a sprue, each of said fingernails being secured to said sprue.

* * * * *